US006951071B1

(12) United States Patent
Acosta et al.

(10) Patent No.: US 6,951,071 B1
(45) Date of Patent: Oct. 4, 2005

(54) ELECTRONIC RIFLE TRIGGER MECHANISM

(76) Inventors: Adelfo Acosta, 15665 SW. 74th Circle Dr. #1, Miami, FL (US) 33193-3361; Elier Aquiar, 12635 SW. 187th St., Miami, FL (US) 33177

( * ) Notice: Subject to any disclaimer, the term of this patent is extended or adjusted under 35 U.S.C. 154(b) by 0 days.

(21) Appl. No.: 10/923,486

(22) Filed: Aug. 20, 2004

(51) Int. Cl.[7] ..... F41A 19/00
(52) U.S. Cl. ..... 42/69.01; 42/84; 42/42.01; 89/135
(58) Field of Search ..... 42/69.01, 84, 41, 42/42.01; 89/135

(56) References Cited

U.S. PATENT DOCUMENTS 2,337,145 A 12/1943 Albree
2,780,882 A 2/1957 Temple
3,748,960 A * 7/1973 Mindel ..... 89/135
3,890,646 A * 6/1975 Fassett et al. ..... 2/8
4,718,187 A * 1/1988 Blake ..... 42/84
4,727,670 A 3/1988 Krouse
5,210,368 A * 5/1993 Heller et al. ..... 86/50
6,374,525 B1 * 4/2002 Thomas ..... 42/51
6,766,794 B1 * 7/2004 Bently ..... 124/35.2

* cited by examiner

*Primary Examiner*—J. Woodrow Eldred
(74) *Attorney, Agent, or Firm*—Ruben Alcoba, Esq.; Laurence J. Edson, Esq.

(57) ABSTRACT

The present invention is directed to a trigger mechanism of an electronic weapon. The trigger mechanism eliminates the need of a shooter having to master the pulling of the trigger of a rifle with the tip of his index finger and also minimizes the importance of proper breathing techniques when firing the rifle.

The trigger mechanism of the electronic weapon has two major components. The first is a mouth operated switch that facilitates the firing of the electronic rifle. The second piece is the electronic rifle. The two pieces might be connected using an electrical cord or a radio frequency.

9 Claims, 5 Drawing Sheets

ELECTRONIC RIFLE TRIGGER MECHANISM

BACKGROUND

One of the most difficult things to do when shooting a rifle for marksmanship is maintaining the body still when pressing the trigger of a rifle. One of the most frequent complications of firing a rifle is the pulling of the rifle in a horizontal direction when pressing the trigger. An un-experienced shooter will usually miss the target either to the left or the right of the mark, depending on whether the shooter shoots from the right or the left side. The reason for the complication is the positioning of the index finger on the trigger. An expert will tell a shooter to only place the tip of the index finger on the trigger so that when the trigger is pulled only a minimal sideways pull will be exerted on the rifle. The above concept seems simple, but if you ask any soldier taught to fire a rifle, this is easier said than done. The reason that the above concept is difficult is because the shooter also has to exhale prior to pulling the trigger to obtain optimum results.

The invention overcomes the above problem by eliminating the need to pull the trigger with an index finger, thereby eliminating the sideways pull of the rifle. This invention simply requires the shooter to aim the rifle at a mark and once the mark is realized, the shooter will bite a mouth trigger that will fire the rifle.

The concept of having an electronically fired weapon is not new in the art. Information relevant to attempts of reducing the movement of a rifle when firing the rifle can be found in U.S. Pat. Nos. 2,337,145, 2,780,882, 4,718,187, and 4,727,670. However, each one of these references does not solve the problem of the pull of the weapon or the time that it takes the brain to send the finger the message to pull the trigger.

An object of this invention is to it eliminate the need of using an index finger when firing a rifle, thereby eliminating the sideways pull of the rifle when firing the rifle.

Another object of this invention is to allow a shooter not to have to master two functions when shooting a mark, the pulling of the trigger with the tip of an index finger and the exhaling of the air in ones lungs prior to the pulling of the trigger, thereby minimizing the shooter's movements and maximizing the chances of the shooter hitting his mark. With the current invention, the shooter simply marks the mark and then bites the mouth trigger when firing.

SUMMARY

The present invention is directed to a trigger mechanism of an electronic weapon. The trigger mechanism eliminates the need of a shooter having to master the pulling of the trigger of a rifle with the tip of his index finger and also minimizes the importance of proper breathing techniques when firing the rifle.

The trigger mechanism of the electronic weapon has two major components. The first is a mouth operated switch that facilitates the firing of the electronic rifle. The second piece is the electronic rifle. The two pieces might be connected using an electrical cord or a radio frequency.

The electronic rifle is operated as follows: 1. loading a bullet into the receiver of the electronic rifle, 2. connecting the mouth operated switch to the electronic rifle, 3. placing the mouth operated switch into the shooters mouth, 4. switching the off/on switch of the electronic rifle to the on position, 5. marking the mark that the shooter is aiming at, and 6. biting the mouth operated switch thereby firing the bullet within the electronic rifle.

DRAWINGS

These and other features, aspects, and advantages of the present invention will become better understood with regard to the following description, appended claims, and drawings where:

DESCRIPTION

Figure 1:
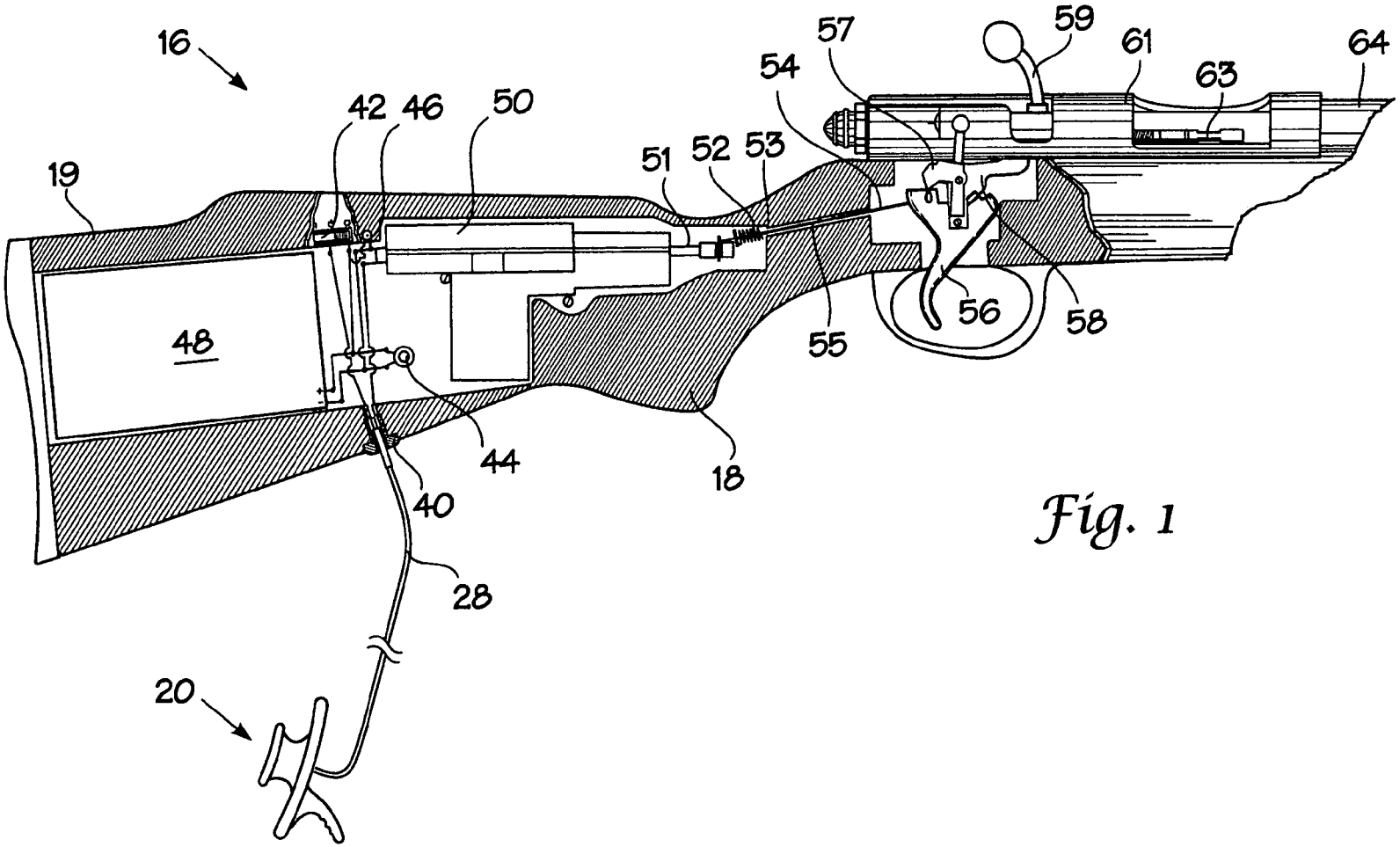
FIG. 1 shows a fragmentary longitudinal section though an electronic rifle having a trigger mechanism for the firing of the electronic rifle which embodies the present invention.

As shown in FIG. 1, a trigger mechanism for the firing of an electrical weapon comprises a mouth operated switch 20 and an electronic rifle 16 connected to the mouth operated switch 20 through means known in the art.

As shown in FIGS. 3–6B, the mouth operated switch 20 comprises of a first elongated body 26, a second body 22, having a first 22A and a second side 22B, having a depth and width sufficient to allow a shooter's teeth to bite into the middle of the second body 22 and wherein the second body 22 has a circuit 32, 34 that closes when the second body 22 is bitten, wherein the first side 22A of the second body is attached the first elongated body 26, and a third elongated body 24 that is attached to the second side 22B of the second body 22, and wherein an electrical cord 28 passes through the third elongated body 24 and connects to the circuit of the second body 22, the third elongated body 24 being longer in length than the first elongated body 26.

Figure 6:
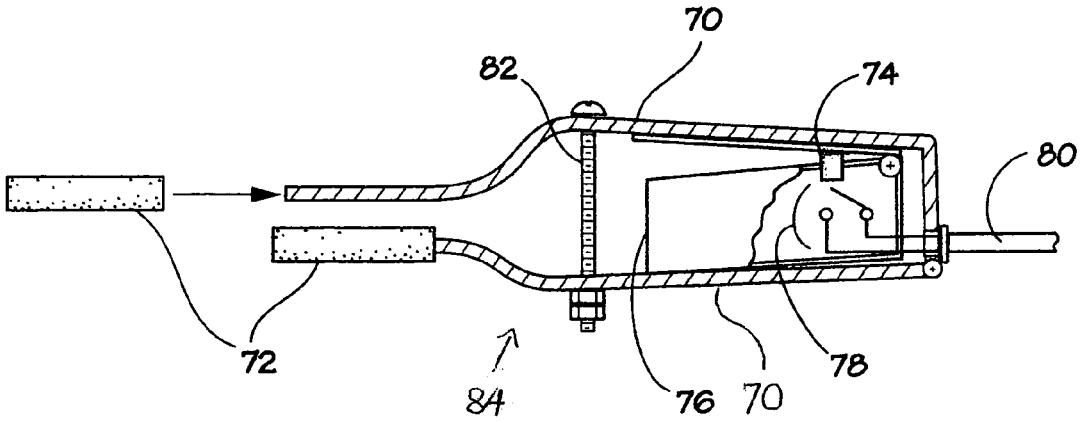
FIG. 6 shows another embodiment of the mouth operated switch.

As shown in FIG. 6, another embodiment of the mouth operated switch comprises a u-shaped body 84, wherein the arms 70 of the u-shaped body s-curve inward approximately ⅔ of the length from the perpendicular part of the u-shaped body 84 and wherein the arms 70, after coming out of the s-curve, extend outward in the same direction that the arms 70 where in prior to entering the s-curve; a switch 76 that is housed within the u-shaped body 84 that attaches to one of the arms 70 of the u-shaped body 84 and that is further adjacent to the perpendicular part of the u-shaped body 84, wherein the switch 76 has a spring loaded arm 74 that rests on the second arm of the u-shaped body 84 and wherein the switch 76 further connects to the electrical cord 28; and a tension piece 82 that is placed through the arms 70 of the u-shaped body 84 prior to the s-curve commencing. The u-shaped body 84 could further comprise two sleeves 72 that are placed on the ends of the u-shaped body 84.

Referring to FIG. 1, there is an electronic rifle 16 which comprises a stock 18, a receiver 59, having a firing pin 63 and a barrel 64, mounted on the stock 18, a bolt 61 mounted on said receiver 59, a trigger 56 mounted on said stock 18, a sear 58 mounted on the stock 18, the sear 58 abuts the trigger 56 and the firing pin 63 within the receiver 59, a rod 54 that abuts said trigger 56, wherein said 54 rod is housed in a channel 55 that has been bored through the stock 18, a solenoid 50 that is mounted on the stock 18, the solenoid 50 having a core 51 that is connected to the rod 54, a spring 52 that surrounds the rod 54 at a point wherein the core 51 of the solenoid 50 will abut one of the sides of the spring and the other side of the spring will further abut an ingrained edge 53 of the stock 18, a battery 48 that is placed within the butt 19 of the stock 18, wherein the battery 48 will be connected by a rifle circuit to the solenoid 50, a receiving receptor 40, and a charging receptor 44 (both the receiving receptor 40 and the charging receptor 44 are mounted on the stock 18), and an off/on switch 42 that is mounted on the stock 18 that is attached to the rifle circuit. The receiving receptor 40 receives the electrical cord 28 that is attached to the mouth operated switch 20.

In another embodiment of the invention, the receiving receptor 40 could eliminate the need of the cord 28 by having the ability of receiving a radio frequency. In this later embodiment, the mouth operated switch 20 would send a radio signal to the receiving receptor 40 when bitten by the shooter. The mouth operated switch 20 would have a radio frequency transmitter built within. The method of placing the transmitter within the mouth operated switch 20 is known in the art.

Figure 2A:
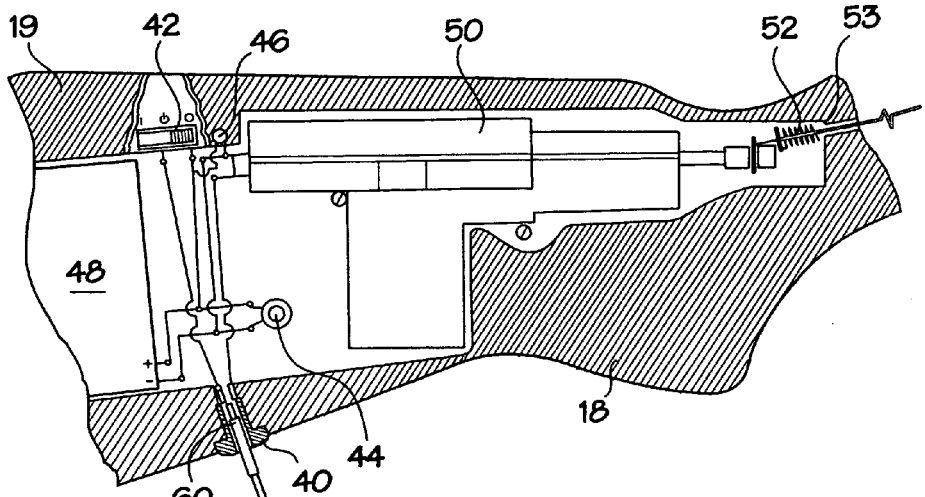
FIG. 2A is an enlarged fragmentary longitudinal section through the same rifle showing the electrical connections within the stock of the rifle.

Referring to FIG. 2A, the rifle circuit shows the electric current flow when the off/on switch 42 is left in the on position. The off/on switch 42 serves as a safety to the electronic rifle 16, for if the off/on switch 42 is left in the off position, the current will be prevented from looping thereby preventing the charging of the solenoid 50. If the solenoid 50 is not charged, the solenoid will not push the core 51 outward when the mouth operated switch 20 is closed.

Figure 2B:
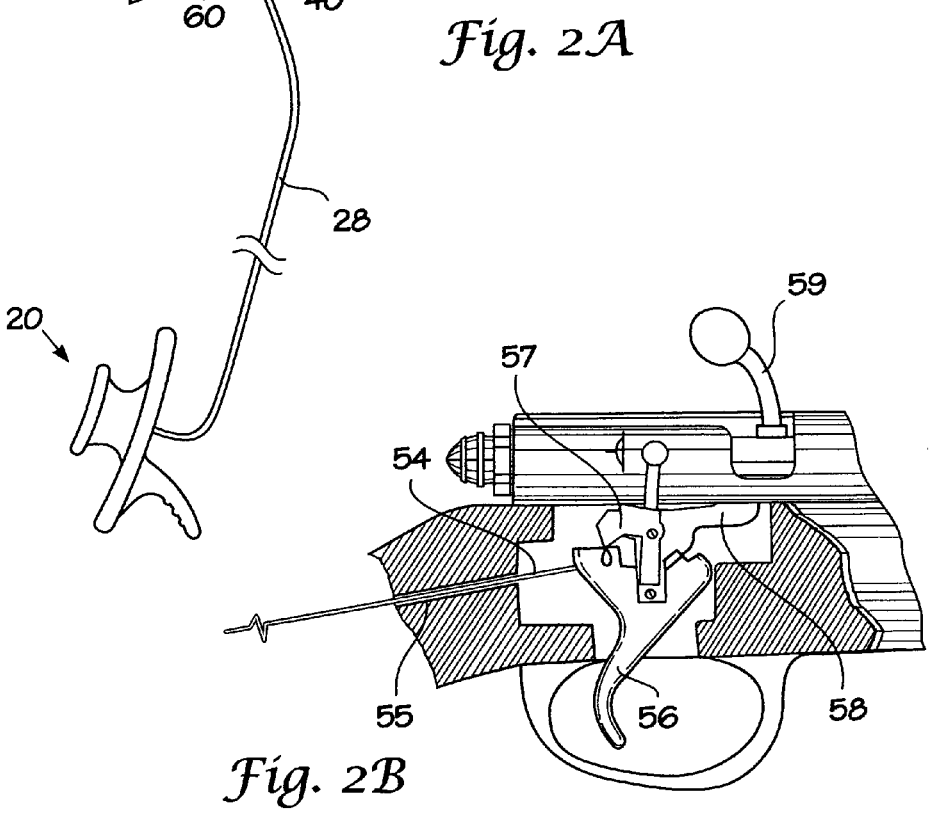
FIG. 2B is another enlarged fragmentary longitudinal section through the same rifle showing how a rod attaches to a trigger on the rifle.
Figure 3:
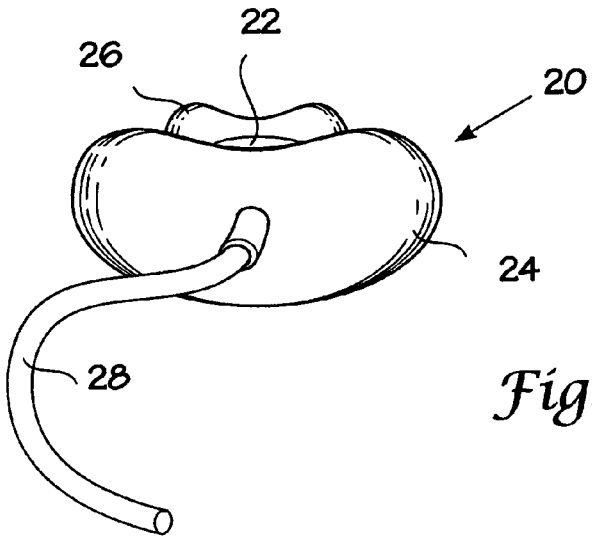
FIG. 3 shows a perspective view of a mouth operated switch and electrical cord attachment of the present invention.

Referring to FIG. 2B, the rod 54 to trigger 56 connection is shown. When the rod 54 is pushed toward the trigger 56, the trigger 56 will release the sear 58 and the firing pin 63 within the receiver thereby discharging the electronic rifle 16. For the above action to happen, a bullet has to be placed within the receiver and loaded.

Figure 4A:
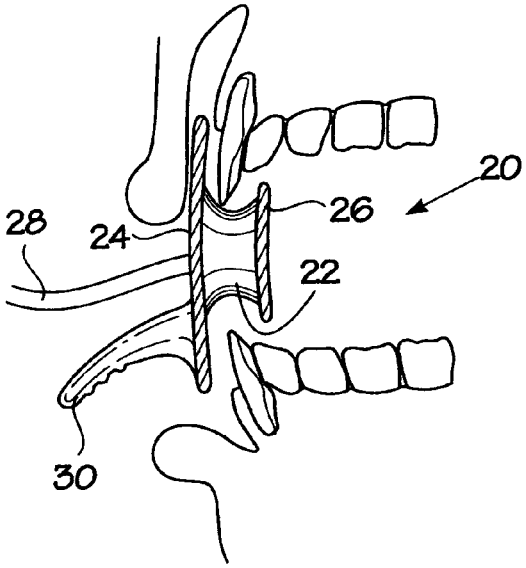
FIG. 4A shows a side view of the mouth operated switch in the mouth of a shooter in the open circuit position.
Figure 4B:
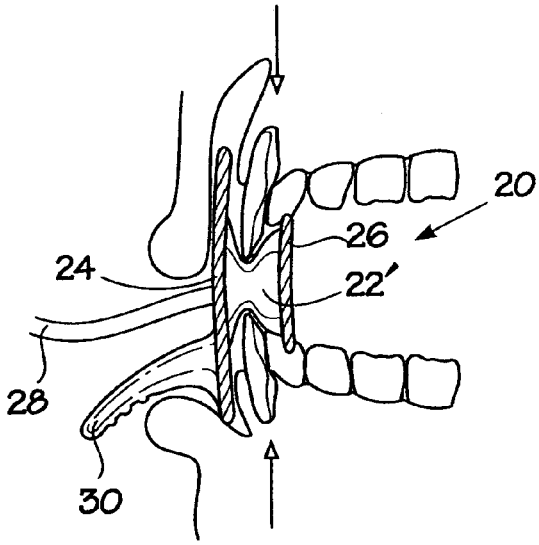
FIG. 4B shows a side view of the mouth operated switch in the mouth of a shooter in the closed circuit position.
Figure 5A:
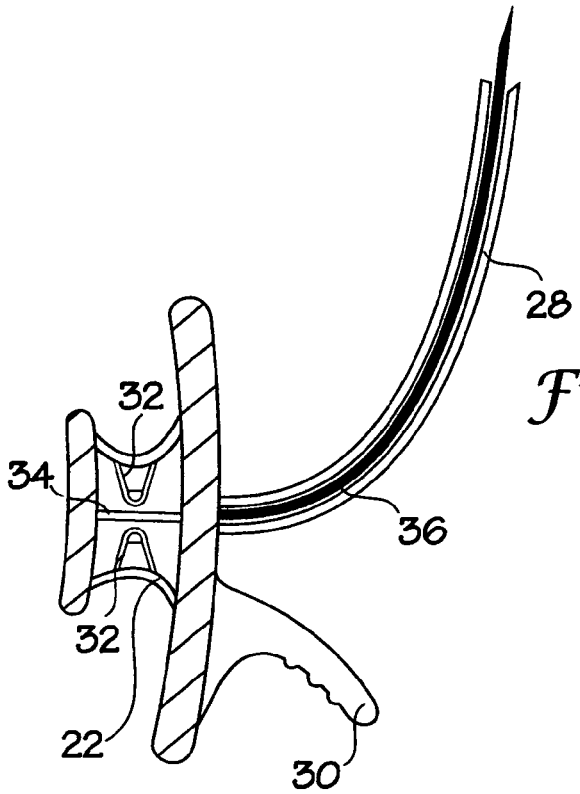
FIG. 5A shows another side view of the mouth operated switch showing the circuit in the open position.
Figure 5B:
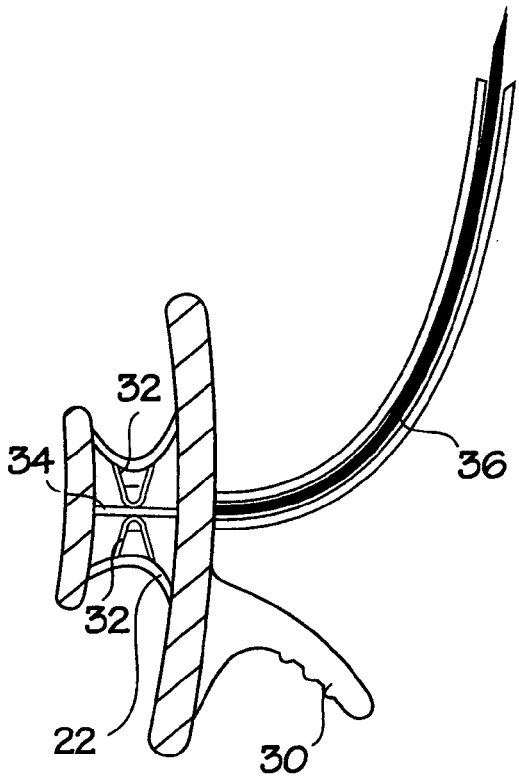
FIG. 5B shows a last side view of the mouth operated switch showing the circuit in the closed position.

The electronic rifle 16 is used by first loading a bullet into the receiver 59, then connecting the electric cord 28 into the receiving receptor 40, then placing the mouth operated switch 20 into the shooter's mouth as seen in FIG. 4A, then switching the off/on switch 42 into the on position, then marking the mark that the shooter is aiming at, and lastly firing the electronic rifle 16 by biting the mouth operated switch 20 as seen in FIG. 4B.

Another embodiment of the electronic rifle 16 is used by first loading a bullet into the receiver 59, then placing the mouth operated switch 20 into the shooter's mouth as seen in FIG. 4A, then switching the off/on switch 42 into the on position, then marking the mark that the shooter is aiming at, and lastly firing the electronic rifle 16 by biting the mouth operated switch 20 as seen in FIG. 4B. This embodiment requires that the receiving receptor 40 has the capacity of receiving radio frequencies and that the mouth operating switch 20 has the capacity of sending radio frequencies.

An advantage of the invention is that it eliminates the need of using an index finger when firing the electronic rifle, thereby eliminating the sideways pull of the rifle when firing the conventional rifle.

Another advantage of this invention is that it allows the shooter of the electronic rifle not to have to master two functions when shooting at a mark, the pulling of the trigger with the tip of an index finger and the exhaling of the air in ones lungs prior to the pulling of the trigger, thereby minimizing the shooter's movements and maximizing the chances of the shooter hitting his mark.

Although the present invention has been described in considerable detail with reference to certain preferred versions thereof, other versions are possible. Therefore the spirit and the scope of the claims should not be limited to the description of the preferred versions contained herein.

What is claimed is:

1. A trigger mechanism comprising:

a mouth operated switch; and a rifle in communication with the mouth operated switch, wherein the rifle has a stock;

a receiver, having a firing pin and a barrel, mounted on said stock;

a bolt mounted said receiver;

a trigger mounted on said stock;

a sear mounted on the stock, the sear abutting the trigger and the firing pin within the receiver;

a rod abutting said trigger, wherein said rod is housed in a channel bored through the stock;

a solenoid mounted on the stock, the solenoid having a core connected to the rod;

a spring that surrounding the rod at a point wherein the core of the solenoid abuts one of the sides of the spring and the other side of the spring further abuts an ingrained edge of the stock;

a battery placed within the butt of the stock, wherein the battery connects a rifle circuit to the solenoid, a receiving receptor, and a charging receptor; and an off/on switch mounted on the stock that is attached to the rifle circuit.

2. The trigger mechanism of claim 1, further comprising an electrical cord connecting the mouth operated switch to the rifle, thereby allowing the switch to communicate with the rifle.

3. The trigger mechanism of claim 2, wherein the mouth operated switch comprises:

a first elongated body;

a second body, having a first and a second side, with a depth and width sufficient to allow a shooter's teeth to bite into the middle of the second body, wherein the second body has a circuit that closes when the second body is bitten, the first side of the second body attaching the first elongated body; and a third elongated body attaching the second side of the second body, wherein the electrical cord passes through the third elongated body and connects to the circuit of the second body, the third elongated body being greater in length than the first elongated body.

4. The trigger mechanism of claim 3, wherein the three bodies of the mouth operated switch are made of polymer materials.

5. The trigger mechanism of claim 3, wherein the three bodies of the mouth operated switch are made of rubber.

6. The trigger mechanism of claim 2, wherein the mouth operated switch comprises:

a u-shaped body, having arms s-curve inward approximately ⅔ of the length from the perpendicular part of the u-shaped body and wherein the arms, after coming out of the s-curve, extend outward in the same direction that the arms where in prior to entering the s-curve;

a switch housed within the u-shaped body attaching one of the arms of the u-shaped body and adjacent to the perpendicular part of the u-shaped body, wherein the switch has a spring loaded arm resting on the second arm of the u-shaped body and wherein the switch further connects to the electrical cord; and a tension piece placed through the arms of the u-shaped body prior to the s-curve commencing.

7. The trigger mechanism of claim 6, wherein the unshaped body further comprises two sleeves placed on the ends of the u-shaped body.

8. The trigger mechanism of claim 1, wherein the rifle receives radio frequencies and the mouth operated switch sends radio frequencies.

9. A method of using the trigger mechanism of claim 1, comprising:

loading a bullet into the receiver;

connecting the electric cord into the receiving receptor;

placing the mouth operated switch into the shooter's mouth;

switching the off/on switch into the on position;

marking the mark that the shooter is aiming at; and lastly, firing the rifle by biting the mouth operated switch.

* * * * *